United States Patent [19]

Maisonneuve

[11] 4,175,675

[45] Nov. 27, 1979

[54] CONTAINER AND DISPENSING PACKAGE

[76] Inventor: Leo V. Maisonneuve, 4480 N. 40th St., St. Petersburg, Fla. 33714

[21] Appl. No.: 898,375

[22] Filed: Apr. 20, 1978

Related U.S. Application Data

[63] Continuation-in-part of Ser. No. 730,846, Oct. 8, 1976, Pat. No. 4,109,826.

[51] Int. Cl.[2] ..... B65D 5/38

[52] U.S. Cl. ..... 221/72; 221/89; 229/11; 229/87 F

[58] Field of Search ..... 221/25, 70, 71, 72, 221/85, 86, 89; 229/9, 10, 11, 19, 20, 27, 87 F; 206/443, 526

[56] References Cited

U.S. PATENT DOCUMENTS

| | | | |
|---|---|---|---|
| 1,715,021 | 5/1929 | Wolf | 229/11 X |
| 2,474,166 | 6/1949 | Rumsey | 229/20 X |
| 4,109,826 | 8/1978 | Maisonneuve | 221/72 |

*Primary Examiner*—Francis J. Bartuska
*Attorney, Agent, or Firm*—Arthur W. Fisher, III

[57] ABSTRACT

A container and dispensing package comprising an outer carton, an inner wrapper and an opening structure wherein the outer carton comprises an enclosure to house the inner wrapper to contain foodstuffs and the like, the inner wrapper is attached to the outer carton such that light pulling of an outer flap by the user actuates the opening structure to open the outer carton and inner wrapper to permit access to the contents within the container and dispensing package.

4 Claims, 6 Drawing Figures

FIG. 1
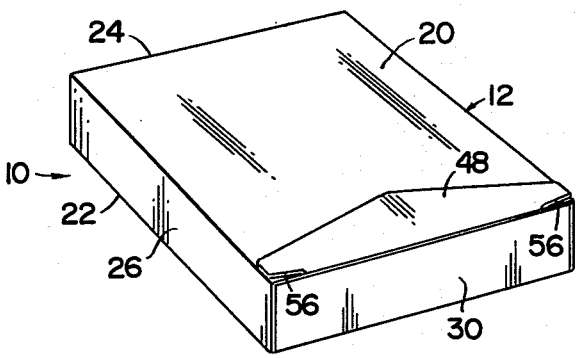
FIG. 6
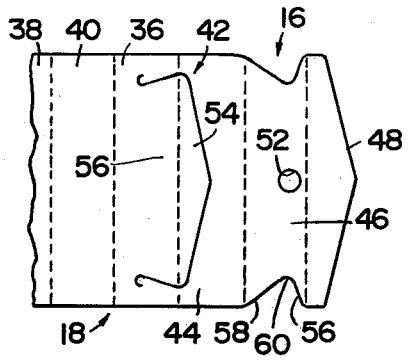
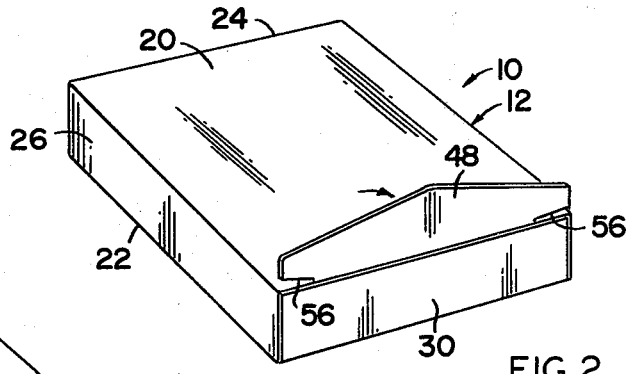
FIG. 2
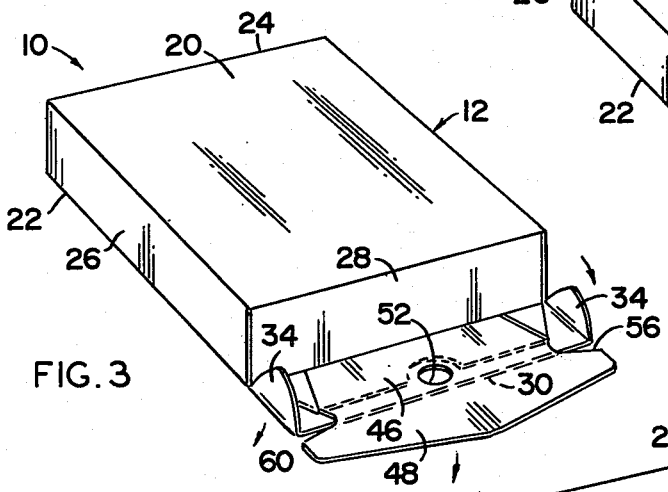
FIG. 3
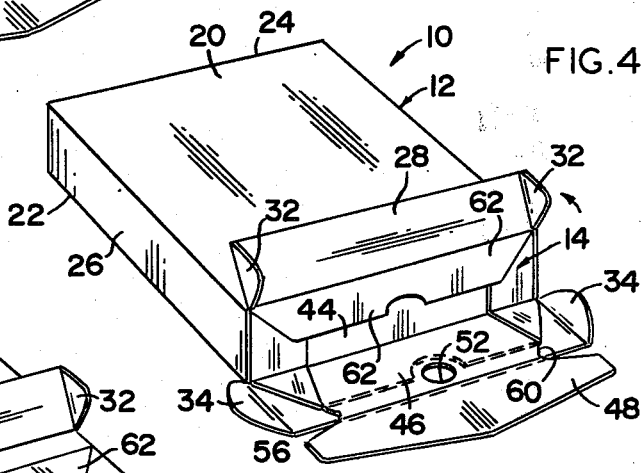
FIG. 4
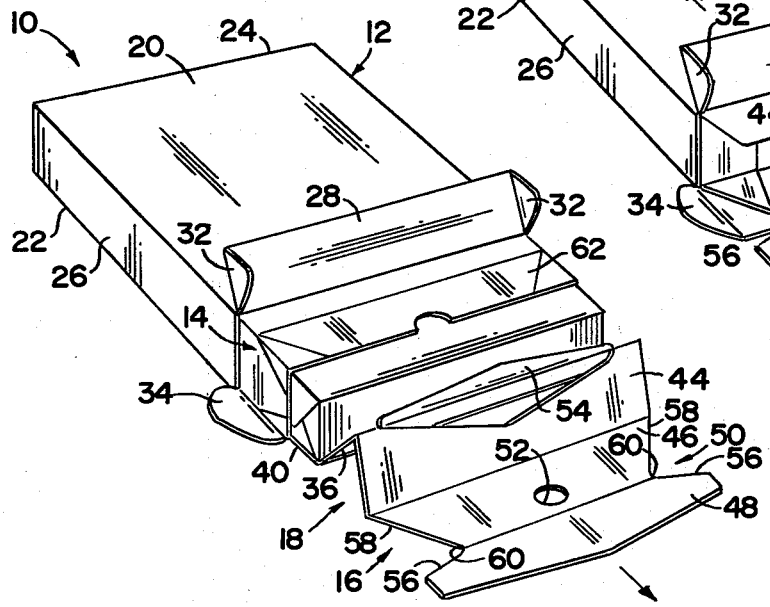
FIG. 5

CONTAINER AND DISPENSING PACKAGE

This is a continuation-in-part application of co-pending United States patent application Ser. No. 730,846 filed Oct. 8, 1976, now U.S. Pat. No. 4,109,826.

BACKGROUND OF THE INVENTION

1. Field of the Invention

A container and dispensing package for foodstuffs and the like.

2. Description of the Prior Art

Cartons of the general type described hereinafter have been on the market for years, usually used to contain four or more bars of individually wrapped butter. After the carton is opened, the bars of butter are removed by reaching therein and picking them up. The consumer or user is then faced with the messy task of removing the wrapper from around the bar of butter so that it can be used. This is unsanitary as well as time consuming in that it is likely that the user's hands will come in contact with the bar of butter during the unwrapping process. The expandable tray of the present invention provides a means of containing and exceptionally rapid dispensing of cube sticks of foodstuffs such as butter without being touched by human hands.

Moreover, packages have been developed with compartments which slide in and out of the container. Unfortunately the sides of the compartments are generally rigid and do not allow easy removal of unwrapped bars of butter. Neither do these compartments contain any type of retainer means to separate the top of the contents from the top of the carton so as to prevent the compartments with their contents from tumbling out of the carton.

The following patents were cited in applicant's copending patent application, Ser. No. 730,846 U.S. Pat. Nos. 2,119,019; 2,474,166; 3,550,809; 3,613,143; Fed. Rep. of Germany Pat. No. 593,522 and United Kingdom Pat. No. 916,012.

SUMMARY OF THE INVENTION

The subject of this invention relates to unique and useful package with ease of access in a sanitary manner for foodstuffs and the like. This unique type of package permits the contents to be completely removed rapidly from its wrapper without the necessity of being touched or handled.

The package comprises an outer carton including an upper and lower end flap similar to those on the market, an inner wrapper to enclose the contents so as to keep them fresh and protected, and an opening means. The package may further include an expandable tray which contains cube sticks within the carton as described in detail in co-pending application Ser. No. 730,846.

The expandable unit comprises a single piece of light cardboard folded in such a way as to form separate compartments or troughs into which individual cube sticks are placed. The expandable tray pulls out from the front in an accordian fashion such that the walls or partitions of the troughs fall away from the front and rear of the cube sticks. The bars of butter are thus bare and ready to be placed within a spread dispensing device or in a butter dish or otherwise used.

The inner wrapper is comprised of wax paper or similar material which protects and keeps the contents fresh and free from moisture.

The opening means comprises a separation member including a pair of wrapper folding and opening elements formed on opposite sides thereof.

The separation member coupled to an attachment flap is normally disposed between the upper and lower upper end flaps to engage the inner wrapper such that the package can be opened merely by lightly pulling on the attachment flap formed on forward portion of the expandable tray or the outer carton itself.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a perspective view of a closed container and dispensing package.

FIG. 2 is a similar perspective view of a container and dispensing package showing the attachment flap open.

FIG. 3 is a similar perspective view of a container and dispensing package showing the package partially opened.

FIG. 4 is a similar perspective view of a container and dispensing package showing the package further opened.

FIG. 5 is a similar perspective view of a container and dispensing package showing the expandable tray and its contents removed therefrom.

FIG. 6 is a top view of a blank from which an expandable tray is formed.

Similar reference characters refer to similar parts throughout the several views of the drawings.

DETAILED DESCRIPTION OF THE PREFERRED EMBODIMENT

As best shown in FIGS. 4 and 5 the present invention relates to a container and dispensing package for foodstuffs and the like generally indicated as 10 comprising an outer carton 12, and inner wrapper 14, and an opening means generally indicated as 16. The container and dispensing package 10 may further include an expandable tray 18 as described in copending application Ser. No. 730,846.

As shown, the outer carton 12 comprises an upper and lower wall 20 and 22 respectively together with rear wall 24. A pair side walls 26 are formed on opposite sides of the upper and lower walls 20 and 22. Inner and outer end flaps 28 and 30 respectively are formed on upper and lower walls 20 and 22 respectively. The inner and outer end flaps 28 and 30 respectively are disposed to close the outer carton 12 when in a first position and to open the outer carton 12 when in a second position. Formed on opposite sides of the inner and outer end flaps 28 and 30 respectively are upper and lower end tabs 32 and 34 respectively.

As best shown in FIGS. 5 and 6, the expandable tray 18 comprises a single piece of light cardboard or the like folded in such a way as to form a plurality of compartments or troughs in which cube sticks of foodstuffs such as butter are stored. As described in detail in co-pending application Ser. No. 730,846 and shown in FIG. 6, each trough comprises a forward partition 36, a rear partition 38 and a floor 40 therebetween which forms the bottom of the trough. Each compartment may further include a retainer means generally indicated as 42 on the forward portion of each trough. An end wall 44 is attached to the forward portion of the expandalbe tray 18. Located adjacent to the forward end wall 44 is a separation member 46 having an attachment flap 48 extending from the forward portion thereof. The rear partition 38 of each trough is adjacent to the forward partition 36 of the next adjacent trough as described in detail in co-pending application Ser. No. 730,846.

The separation member 46 comprises a pair of wrapper folding and opening elements generally indicated as 50 on opposite sides thereof and a separation member aperture 52 formed near the center thereof adjacent the attachment flap 48. Each wrapper folding and opening element 50 comprises a substantially triangularly-shaped segment 54 cut from opposite sides of the separation member 46. The segments 54 each comprise first and second legs 56 and 58 respectively extending inwardly from the front and rear portions of the separation member 46. The first and second legs 56 and 58 intersect at the included angle 60. The included angles 60 are concave to accommodate the inner wrapper 14 near the opening of the package 10. The attachment flap 48 is formed generally in the shape of an obtuse triangle.

When the package 10 is closed as shown in FIG. 1, the attachment flap 48 lies outside the carton 12 and is adhesively attached to the upper wall 20 thereof. The separation member 46 lies between the inner and outer end flaps 28 and 30 respectively of the outer carton 12 as best shown in FIG. 3. The inner end flap 28 is innermost in the carton 12. Forward and adjacent thereto is the separation member 46. Adjacent thereto and forming the outside of the opening is the outer end flap 30. Thus the opening of the carton 12 is securely closed while the attachment flap 48 of tray 18 is allowed to extend outside the closed carton 12.

The retainer means 42 comprises a guard flap 54 and a spring member 56, as described in co-pending application Ser. No. 730,846.

The inner wrapper 14 is comprised of wax paper or similar material which protects and keeps the materials contained within the carton 12 fresh and free from moisture. When the package 10 is open the inner wrapper 14 extends past the opening of the package 10.

The excess of wax paper of the wrapper 14 near the opening of the package 10 is conveniently tucked in at the wrapper folding and opening elements 50 such that upper portion 62 lies between forward end wall 44 and inner end flap 28, while the lower portion 64 lies between the separation member 56 and the outer end flap 30, when the package 10 is closed. At the rear of the package 10, the inner wrapper 14 is adhesively attached to the carton 12 so as to prevent the wrapper 14 from being removed therefrom when the expandable tray 18 is pulled out.

The package 10 is easily and conveniently opened by the user pulling on the attachment flap 48 until the adhesive bond with the outer carton 12 is broken. The user's continued pulling on the attachment flap 48 causes the adhesive bond between the inner and outer end flaps 28 and 30 respectively to break and allowing each to open as the expandable tray 18 is pulled outwardly from the carton 12. Due to the construction of the wrapper folding and opening elements 50 to accommodate the interfolding of the wrapper 14 therearound, the inner wrapper 14 pulls away from the front of the expandable tray 18, which then easily slides out of the carton 12.

The forward end wall 44 in the case of the table spread package is attached in a like manner to the forward partition 36 of the expandable tray 18. The expandable tray 18 being the vehicle for removing the table spread from the carton 12. The separation member 46 is so named because it lies between the inner and outer carton flaps 28 and 30 respectively thus positioning them in separate positions on each side of the separation member 46. The separation member 46 is also interfolded with the outer end of the inner wrapper 14. The inner wrapper 14 and separation member 46 interfolding cannot take place without the existence of wrapper opening and folding elements 50 each side of the separation member 46. The wrapper opening and folding elements 50 also serve as open recesses at which points the inner and outer carton flaps 28 and 30 can be attached together with adhesive. The other point of attachment is the aperture 52 located at the center of the separation member 46.

As previously described, the carton 12 is closed by interfolding sequence of: innermost and lying folded against the forward end wall 44 is the upper and side portions 62 of the inner wrapper 14, inner end flap 28, and the separation member 46. Since the separation member 46 is interfolded into the lower wrapper end 64 on each side of the separation member 46 at the wrapper folding and opening elements 50 the side portions of the lower wrapper ends 64 will be disposed between the outer side of the inner carton flap 28 and the inner side of the separation member 46. Without these folding and opening elements 50 these necessary folds on either side of the separation member 46 could not be made. Folded against the outer side of the separation member 46 is the outer wrapper end 64. Folded over the lower wrapper end 64 is the outer carton flap 30. To prevent unfolding the inner carton flap 28 and the outer carton flap 30 are affixed together with adhesive at the recessed points provided by the folding and opening elements 50.

When opening the carton this physical sequence of events takes place as follows.

Releasing the attachment flap 48 from the top of the carton 12 and pulling it away from the carton 12 exerts a pulling force on the separation member 46. The pulling force exerted by the separation member 46 on the carton flaps 28 and 30 causes the release of the adhesive that attaches the carton flaps 28 and 30 together. As the pulling force continues the carton flaps 28 and 30 are forced to separate and the interfolded wrapper around the separation member 46 begins to unfold. The separation member 46 now pulling the forward end wall 44, away from the carton 12 completes the opening procedure.

If something other than table spread, confectioneries, forzen foods or the like (that which need not be separated) the expandable tray 18 may not be needed but instead a flat tray may take the place of the expandable tray 18.

If the contents of the carton 12 are pourable or otherwise not in need of a tray the forward end wall 44 will be attached to the upper inside part of the inner wrapper end 62.

If an inner wrapper 14 is not used in the carton then the forward end wall 44 is attached to the underside of the inner end flap 28.

It will thus be seen that the objects set forth above, among those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A container and dispensing package for storing and dispensing contents therefrom comprising an outer carton having an opening therein; together with an inner and outer end flap each movable between a first and second position to selectively permit access to the interior of said outer carton through said opening and an opening means comprising an end wall and a separation member each movable between a first and second position to selectively move said inner and outer end flaps from said second position, an inner wrapper fixedly attached to said outer carton to protect the contents thereof and disposed to extend outwardly from said opening when said inner and outer end flaps are in said second position and said opening means further includes a pair of wrapper folding and opening elements on opposite sides of said separation member to accommodate folds of said inner wrapper therearound and to open said inner wrapper when said inner and outer end flaps are in said second position, said end wall is disposed inwardly relative to said inner end wrapper and said separation member is disposed between said inner and outer end flaps when each is in said first position.

2. The container and dispensing package of claim 1 each said wrapper folding and opening element comprises a triangular shaped segment cut from said separation member, said triangular shaped segment comprising a first leg extending inwardly from the front portion of said separation member, a second leg extending inwardly from the rear portion of said separation member and a concave included angle at the intersection of said first leg and said second leg.

3. The container and dispensing package of claim 1 further including an expandable tray for holding the contents of said package removably disposed within said outer carton, said expandable tray comprising a plurality of adjacent compartments each comprising a forward and a rear partition each movable between a first and second position, said forward and rear partitions disposed to engage the contents when in said first position and to disengage the contents when in said second position, a floor extending between said forward and rear partitions upon which the contents are placed and means for at least partially removing said expandable tray from said outer carton.

4. A container and dispensing package for storing and dispensing contents therefrom comprising an outer carton having an opening therein; and expandable tray for holding the contents of the package removably disposed within said outer carton, said expandable tray comprising a plurality of adjacent compartments each comprising a forward and a rear partition each movable between a first and second position, said forward and rear partitions disposed to engage the contents when in said first positions and to disengage the contents when in said second position, a floor extending between said forward and rear partitions upon which the contents are placed, and means for at least partially removing said expandable tray from said outer carton, said package further comprising an inner wrapper fixedly attached to said outer carton and disposed to substantially enclose said expandable tray to protect the contents thereof and disposed to extend outwardly from said opening when said expandable tray is withdrawn from said outer carton, said means for at least partially removing said expandable tray from said outer carton comprises a separation member attached to said expandable tray, said separation member including a pair of wrapper folding and opening elements on opposite sides thereof to accommodate folds of said inner wrapper therearound and allow said inner wrapper to disengage from said expandable tray when withdrawn from said outer carton, each said wrapper folding and opening elements comprises a triangular shaped segment comprising a first leg extending inwardly from the front portion of said separation member and a second leg extending inwardly from the rear portion of said separation member to form said substantially concave included angle at the intersection of said first leg and said second leg.

* * * * *